United States Patent [19]

MacGregor

[11] Patent Number: 4,621,476

[45] Date of Patent: Nov. 11, 1986

[54] GROUNDING ELECTRODE

[76] Inventor: Harvey J. MacGregor, 14700, 110th Avenue, Surrey, British Columbia, Canada, V3R 2A8

[21] Appl. No.: 761,954

[22] Filed: Aug. 2, 1985

[30] Foreign Application Priority Data

Feb. 8, 1985 [CA] Canada ..... 473895

[51] Int. Cl.[4] ..... H01R 4/66

[52] U.S. Cl. ..... 52/741; 52/173 R; 52/295; 52/742; 174/6

[58] Field of Search ..... 174/2, 3, 6, 7; 339/14 R, 14 L; 52/295, 173 R, 741, 742

[56] References Cited

U.S. PATENT DOCUMENTS

| | | | |
|---|---|---|---|
| 3,755,982 | 9/1973 | Schmidt | 52/295 |
| 3,963,210 | 6/1976 | Macklin | 52/295 X |
| 4,306,397 | 12/1981 | Ramseyer | 52/295 |
| 4,387,543 | 6/1983 | Tschan et al. | 52/295 |

*Primary Examiner*—Laramie E. Askin

*Attorney, Agent, or Firm*—Christie, Parker & Hale

[57] ABSTRACT

A grounding electrode for use in building construction to provide a ground for electrical systems in the building, comprises an elongated metal plate dimensioned to lie within the space filled by footing material when the footings are poured. A metal rod is secured to the plate and is dimensioned to extend upwardly, when the metal plate is in place, to a position above the footings, for grounding connection to an electrical system.

5 Claims, 3 Drawing Figures

GROUNDING ELECTRODE

FIELD OF THE INVENTION

This invention relates to grounding electrodes for use in building construction.

DESCRIPTION OF THE PRIOR ART

It is conventional in city building construction to use the municipal water supply system as a means for grounding electrical systems. Municipal water systems, when constructed of metal, provide an excellent grounding means at minimal cost. However, there is a problem in buildings erected in the country where municipal water systems do not extend, or where the municipal water supply pipes are made of plastic material as is increasingly the case.

It is conventional in such installations to drive ten foot rods into the ground, but clearly this is impossible where the rock bed is close to the surface. Also, grounding rods and their connections are subject to mechanical damage and corrosion. Another method of providing grounding is to lay a substantial length of exposed copper wire in a building foundation, and ultimately to connect such wire to the building electrical system. Problems of installation, inspection and theft occur with the latter prior art system.

SUMMARY OF THE INVENTION

The present invention seeks to overcome the problems of the prior art and provides a grounding electrode intended to be embedded in the footings of a building when the footings are poured. The electrode comprises an elongated metal plate dimensioned to lie within the space that will be filled by the footing material, usually concrete, when the footings are poured, and a metal rod secured to the plate and dimensioned to extend upwardly, when the metal plate is in place, to a position above the footings, for connection to an electrical system.

Preferably, the metal plate lies flat when in place, and the rod is secured to the upper surface of the plate. The plate may have two downwardly turned bent ends to space it from the bottom of an excavation whereby when concrete is poured, the plate is embedded thoroughly in the concrete material. The rod may have a laterally extending portion that will project through a foundation wall poured or built on the footings. The plate is desirably approximately 4 feet long, 6 inches wide and $\frac{1}{4}$ inch thick.

DRAWINGS

An embodiment of the invention is illustrated in the attached drawing, wherein.

DESCRIPTION OF THE PREFERRED EMBODIMENTS

Figure 1:
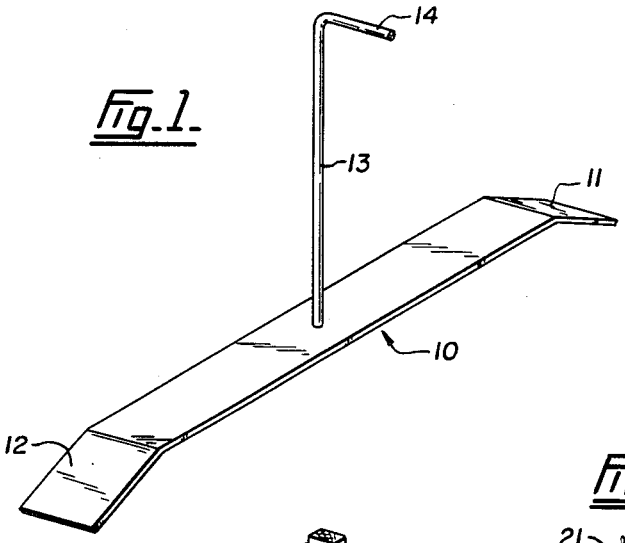
FIG. 1 is a perspective view of a grounding electrode constructed according to the invention.

As will be seen from FIG. 1, the grounding electrode comprises a plate 10 having downwardly turned ends 11 and 12, with the vertical extent of the downward turn being approximately 2 inches so that the main portion of the plate will be spaced 2 inches above grade once the plate is placed in position. Secured, for example by welding, to the upper surface of the plate 10 is a rod 13, the upper portion 14 of which is turned at right angles to the main portion of the rod 13. The portion 14 of the rod is longer than one-half the width of the plate 10, for reasons that will be explained below.

Figure 2:
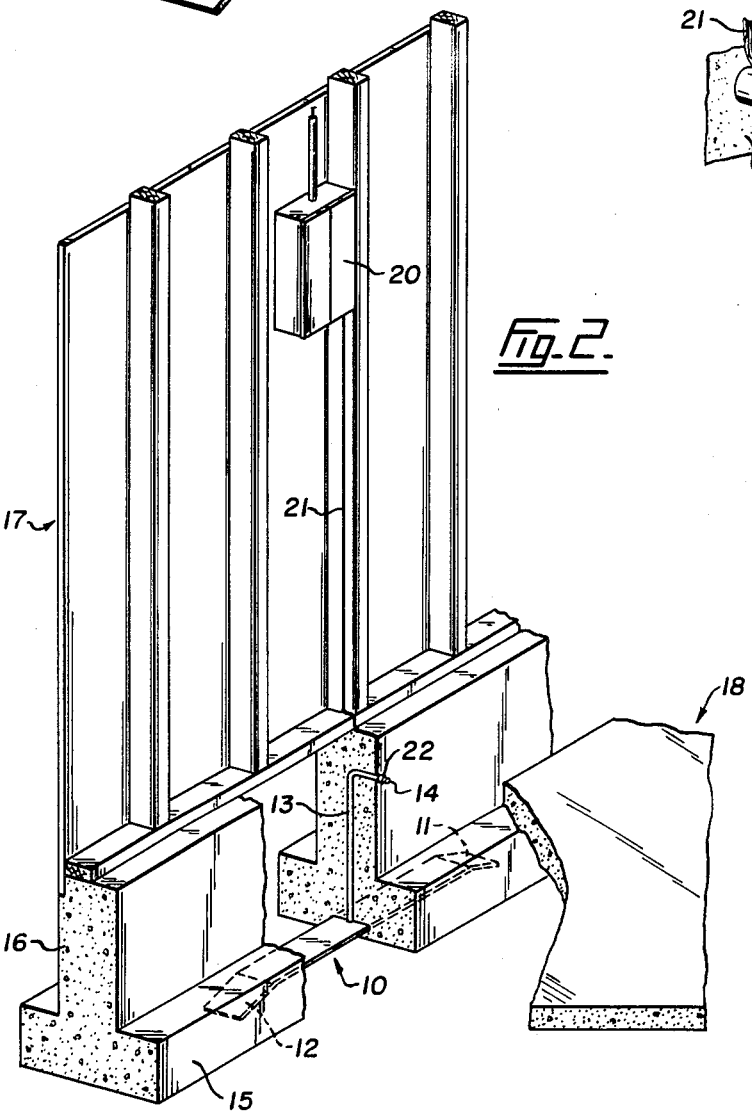
FIG. 2 is a perspective view, partially broken away, of a building in which a grounding electrode has been placed.

In FIG. 2, a typical domestic building is illustrated. It comprises a footing 15 upon which is poured a foundation wall 16. Conventional framing is illustrated at 17. A concrete slab 18 forms the basement floor of the building.

Figure 3:
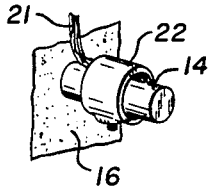
FIG. 3 is a detail of the illustration of FIG. 2.

Prior to pouring of the footing 15, the plate 10 has been placed in position, carefully arranged so that it will llie at the appropriate position within the footing 15. When the basement wall 16 is poured on the footing, portion 14 of the rod 13 extends sideways through the basement wall to project a given distance into the basement area. The main electrical service equipment 20 is connected by grounding wire 21 to the portion 14 of the rod by a clamp 22 as shown in FIG. 3.

It has been found that if the plate is $\frac{1}{4}$ inch stock, dimensioned approximately 48 inches by 6 inches, the conductivity of the concrete is adequate to provide grounding for all normal use. The rod should be $\frac{5}{8}$ inch in thickness.

If the building is a slab on grade construction, essentially the same techniques as described above can be used for installation, however, the plate is installed so that the upstanding portion of the rod extends outwardly from the building.

The plate may be formed from iron or steel, galvanized to resist corrosion and to improve conductivity with the concrete material. Of course, more than one grounding electrode can be provided in buildings where there is a requirement for greater grounding capacity.

The above described electrode is cheaply made and installed, is not subject to mechanical damage or corrosion, and is easily inspected after installation to ensure that Electrical codes are met. The length of the rod 13 may be stamped on the portion 14 so that inspection and verification of the location of the plate is facilitated. Likewise, the monogram of the approving authorities and the name of the manufacturer can be so stamped.

I claim:

1. In a method of providing a grounding electrode in the construction of a building, the construction including forming a foundation by pouring concrete footings, then forming a foundation wall on the footings, the improvement comprising locating in the space to receive the footings, before the concrete to form the footings is poured, a grounding electrode comprising the steps of:

(i) placing in said space an elongated metal plate dimensioned to lie within said space;

(ii) orienting a metal rod secured to said plate extending upwardly to a position above the footings, for connection to an electrical system;

(iii) pouring concrete to form the footings to enclose and locate the elongated metal plate; and (iv) forming the foundation wall on the footings with the metal rod extending from the wall, above the footings to connect to the electrical system.

2. A method as claimed in claim 1 comprising the steps of orienting the metal plate flat on the bottom of the space with the metal rod secured to and extending from an upper facing surface of the plate.

3. A method as claimed in claim 1 wherein the metal plate has at least two downwardly bent ends and comprising the step of orienting the plate such that the bent ends substantially space the plate from the bottom of the space whereby, when the concrete footing is poured, the plate is substantially embedded in the concrete.

4. A method as claimed in claim 1 wherein the step of placing the plate comprises the step of placing a plate which is approximately 4 feet long and six inches wide, with ends of the plate being bent downwardly about 2 inches so that, when the footings are poured, the plate is substantially embedded in the concrete footings.

5. In a method of providing a grounding electrode in the construction of a building, the construction including the steps of pouring concrete footings then pouring concrete on the footings to form a foundation wall, the improvement comprising the steps of (i) locating in the space to receive the footings, prior to pouring the concrete for the footings, a grounding electrode having an elongated metal plate dimensioned to lie within said space;

(ii) extending a metal rod secured to said plate upwardly, when the metal plate is in place in the space, to a position above the footings, for connection to an electrical system;

(iii) extending a laterally extending portion of the metal rod so that it will project through a foundation wall poured on the footings;

(iv) pouring concrete to form the footings and enclose and locate the elongated metal plate; and (v) pouring concrete to form the foundation wall to enclose the remainder of the grounding electrode leaving the laterally extending portion extending from the foundation wall to connect to the electrical system.

* * * * *